US006971740B2

(12) United States Patent
Yuen

(10) Patent No.: US 6,971,740 B2
(45) Date of Patent: Dec. 6, 2005

(54) INK CARTRIDGE REFILL SYSTEM AND METHOD OF USE

(76) Inventor: Kenneth Yuen, P.O. Box 208, San Gabriel, CA (US) 91776

( * ) Notice: Subject to any disclaimer, the term of this patent is extended or adjusted under 35 U.S.C. 154(b) by 0 days.

(21) Appl. No.: 10/438,254

(22) Filed: May 13, 2003

(65) Prior Publication Data

US 2004/0227796 A1 Nov. 18, 2004

(51) Int. Cl.[7] ..... B41J 2/175
(52) U.S. Cl. ..... 347/85
(58) Field of Search ..... 347/85–87; 141/18, 141/319

(56) References Cited

U.S. PATENT DOCUMENTS

| | | | | |
|---|---|---|---|---|
| 5,199,470 A | | 4/1993 | Goldman | 141/1 |
| 5,400,573 A | | 3/1995 | Crystal et al. | 53/568 |
| 5,572,852 A | | 11/1996 | Crystal et al. | 53/528 |
| 5,607,003 A | * | 3/1997 | Gray | 141/285 |
| 5,819,627 A | | 10/1998 | Hayao | 83/861 |
| 5,845,682 A | | 12/1998 | Hayao | 141/18 |
| 5,912,687 A | * | 6/1999 | Cowger et al. | 347/85 |
| 6,053,603 A | * | 4/2000 | Ito | 347/85 |
| 6,099,115 A | * | 8/2000 | Faoro | 347/86 |
| 6,158,848 A | * | 12/2000 | Liu | 347/85 |
| 6,172,695 B1 | * | 1/2001 | Liu | 347/85 |
| 6,347,863 B1 | | 2/2002 | Yuen | 347/85 |

OTHER PUBLICATIONS

"Canon BX-03 Printer Cartridge Refilling Instructions," http://www.pclincs.co.uk/Printer/canon_bx-03.html, 2 pages (Printed Mar. 21, 2000).
"Instructions for use on cartridges Canon BCI-3eC, eM, eY, eBk," http://www.fifty.cz/English/N%C3%A1vody/aRBJ3000.htm, 1 page (Printed Mar. 21, 2003).
"Refilling Instructions," 1 page (Jan. 1998).
"Save on Ink. Frequently Asked Questions," http://trinishops.com/saveonink/faq.htm, 6 pages (Printed Mar. 21, 2003).

* cited by examiner

*Primary Examiner*—Thinh Nguyen
(74) *Attorney, Agent, or Firm*—Merchant & Gould P.C.

(57) ABSTRACT

A system for refilling a printer cartridge is disclosed herein. The system includes an ink refill device having ink-dispensing tubes. The system also includes a guide that mounts to the printer cartridge and functions to guide the ink-dispensing tubes into ink refill passages formed within the cartridge.

16 Claims, 8 Drawing Sheets

INK CARTRIDGE REFILL SYSTEM AND METHOD OF USE

TECHNICAL FIELD

The present invention relates generally to printers. More particularly, the present invention relates to systems and methods for refilling ink cartridges for printers.

BACKGROUND

Ink jet printers are a popular form of printer used with computers and similar applications involving document printing or graphics preparation. Typical ink jet printers have replaceable ink jet cartridges with built-in print heads. While such OEM ink jet cartridges are a convenient manner of supplying ink to printers, the cartridges are expensive due to their complexity and the provision of print heads within the cartridges. Cartridges provided by printer manufacturers are often not designed to be refilled when the ink supply runs out. It is well known, however, that such cartridges have useful lives significantly longer than that provided by the initial supply of ink. Therefore, systems have been developed for refilling cartridges with ink. Example systems are disclosed in U.S. Pat. Nos. 5,199,470; 5,400,573; 5,546,830; 5,572,852; 5,819,627; 5,845,682; and 6,347,863.

SUMMARY

The present disclosure relates generally to systems and methods for refilling ink cartridges. Certain inventive aspects of the present disclosure relate to the use of a guide to facilitate drilling holes into a cartridge and/or inserting refill tubes into holes in a cartridge.

Examples of a variety of inventive aspects in addition to those described above are set forth in the description that follows. It is to be understood that both the foregoing general description and the following detailed description are exemplary and explanatory only and are not restrictive of the broad inventive aspects that underlie the examples disclosed herein.

DETAILED DESCRIPTION

Figure 1:
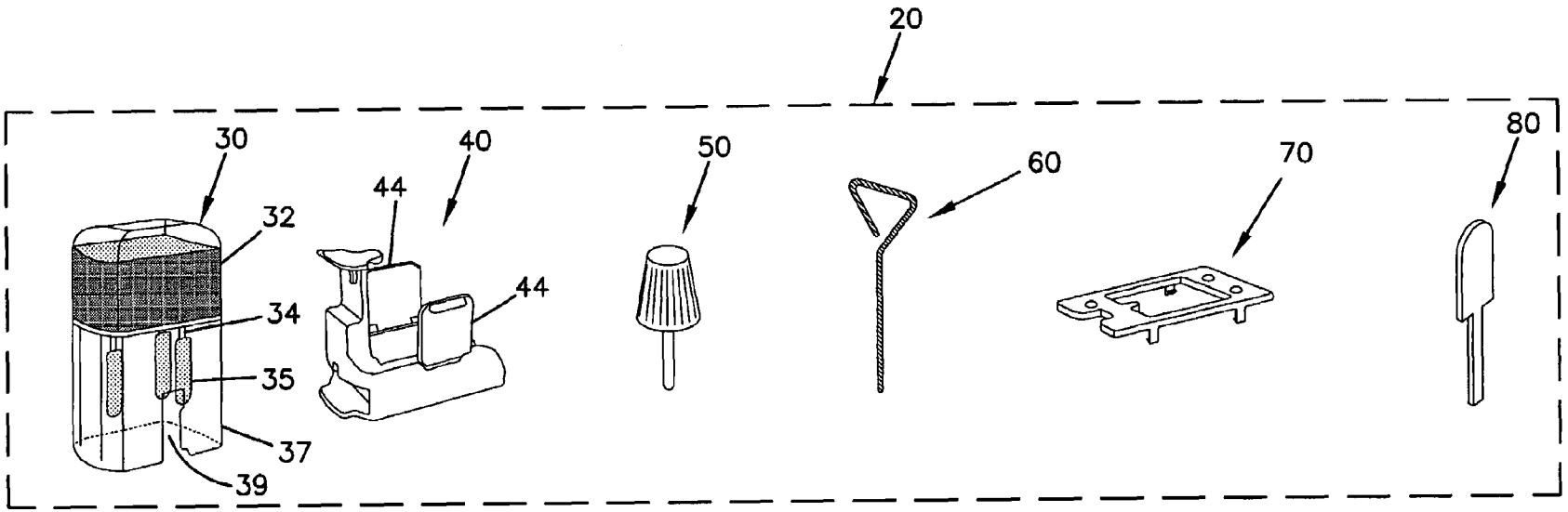
FIG. 1 illustrates a kit having features that are examples of inventive aspects in accordance with the principles of the present disclosure.

FIG. 1 illustrates an ink refill kit 20 for refilling an ink cartridge of a printer. The kit 20 includes an ink refill device 30, a base 40, a drill 50, a foam drill 60, a guide 70 and a lid remover 80.

The ink refill device 30 is preferably equipped with an ink tank 32 having three separate reservoirs 32*a*, 32*b* and 32*c* (see FIG. 12) each containing a different color ink. The three reservoir configuration allows the refill device 30 to be used to refill color cartridges. Separate ink-dispensing tubes 34 are provided for each of the reservoirs. When the ink refill device is not in use, the tubes 34 are preferably blocked by stoppers 35. In other embodiments, the ink tank can have a single reservoir.

The ink refill device 30 also includes a cartridge guide coupled to the ink tank 32. The cartridge guide can have any number of configurations suitable for receiving a cartridge (e.g., cartridge 102 shown in FIG. 8) to maintain a desired alignment between the refill device 30 and the cartridge as the cartridge is interconnected with the refill device 30. In the depicted embodiment, the cartridge guide includes a sleeve 37 that extends outwardly from the ink tank 32 and surrounds the ink-dispensing tubes 34. The sleeve 37 is sized to receive a cartridge cradled within the base 40. Side tracks 39 of the sleeve 37 receive alignment tabs 44 of the base 40 to provide general alignment between the ink refill device 30, the cartridge and the base 40 as the components are slid together. With the cartridge and base 40 inserted within the sleeve 37, the ink-dispensing tubes 34 provide fluid communication between the ink tank 30 and corresponding ink reservoirs in the cartridge.

Prior to insertion of the cartridge into the ink refill device 30, the cartridge is typically prepared so that the ink-dispensing tubes 34 can be readily inserted into the corresponding reservoirs of the cartridge. For cartridges such as a Lexmark 10N0026 cartridge, ink refill passages are drilled through the outer housing of the cartridge with the drill 50 prior to insertion of the cartridge into the sleeve 37. After ink refill passages have been drilled through the housing with the drill 50, the foam drill 60 is used to extend the ink refill passages through interior foam within the cartridge. Thereafter, when the base 40 and cartridge are inserted into the ink refilling device 30, the ink-dispensing tubes 34 fit within the ink refill passages provided by drills 50, 60. In this manner, each reservoir of the ink tank 32 is placed in fluid communication with a corresponding cartridge reservoir containing the same color ink.

For other types of cartridges such as a Lexmark No. 83 (18L0042) or Dell 7Y745 cartridge, the cartridges are prepared by first removing lids of the cartridges with the lid remover 80 so as to expose the interior foam within the cartridges. The foam drill 60 is then used to drill refill passages at the appropriate locations through the foam. Thereafter, each cartridge is inserted in the base 40 and the base/cartridge assembly is inserted in the ink refill device 30 to refill the reservoirs of the cartridge.

For the above-described system to operate efficiently, placement of the refill passages within the cartridge is important. The passages should be drilled through the cartridge such that each refill passage provides access to a separate reservoir within the cartridge. Also, the passages should be aligned such that the ink-dispensing tubes 34 of the device 30 slide within the ink deliver passages when the cartridge is inserted into the sleeve 37 of the ink-dispensing device 30. The guide 70 is provided for insuring that the ink refill passages in the cartridge are provided at the proper locations. The guide 70 also functions to assist in directing the ink-dispensing tubes 34 into the passages.

Figure 3:
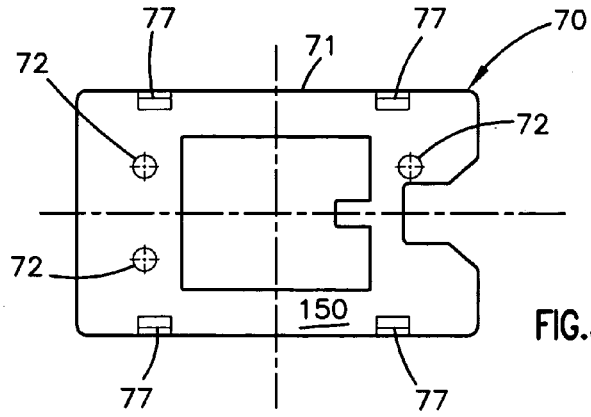
FIG. 3 is a bottom view of the guide of FIG. 2.
Figure 2:
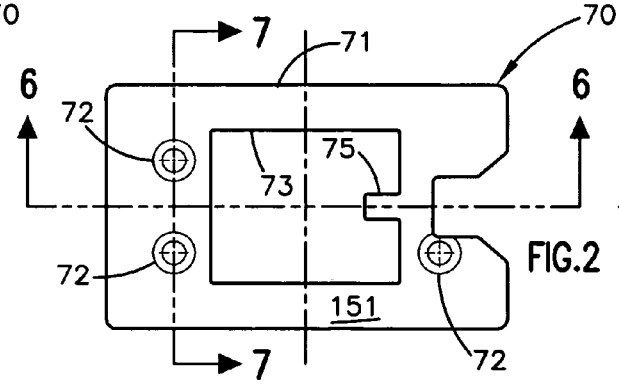
FIG. 2 is a top view of a guide of the kit of FIG. 1.

FIGS. 2–7 show various views of the guide 70. Referring to FIGS. 2 and 3, the guide 70 includes a plate 71 having a first side 150 (see FIG. 3) and a second side 151 (see FIG. 2). The plate defines three guide openings 72 that extend between the first and second sides 150, 151. The guide openings 72 are sized to receive the drill 50, the foam drill 60 and the ink-dispensing tubes 34. The guide 70 is adapted to be mounted on a cartridge with the first side 150 facing toward the cartridge and the second side 151 facing away from the cartridge. When mounted on the cartridge, the guide 70 functions as a template with the openings 72 marking the ink refill passage locations.

Figure 7:
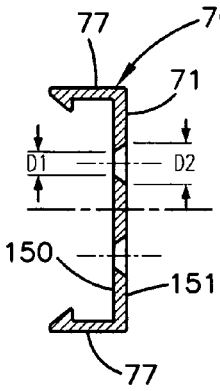
FIG. 7 is a cross-sectional view taken along section line 7—7 of FIG. 2.

Referring to FIG. 7, the guide openings 72 taper as the openings extend from the second side 151 to the first side 150 of the guide plate 71. For example, the openings can have a generally funnel shape having the configuration of a truncated cone. In this manner, the guide openings 72 can have a smaller diameter D1 adjacent the first side 150 of the guide plate 71 and a larger diameter D2 adjacent the second side 151 of the guide plate 71. In one embodiment, the diameter D2 is at least 30% larger than the diameter D1. In another embodiment, the diameter D2 is at least 40% larger than the diameter D1. In still another embodiment, the diameter D2 is at least 50% larger than the diameter D1.

Referring to FIG. 2, the guide 70 includes a keying opening 73 having a tab 75. In use, the keying opening 73 mates with the cartridge in such a manner that the guide 70 can only be mounted on the cartridge in a single orientation. In this way, it is ensured that the guide 70 mounts on the cartridge with the holes 72 in alignment with the reservoirs of the cartridge.

Figure 4:
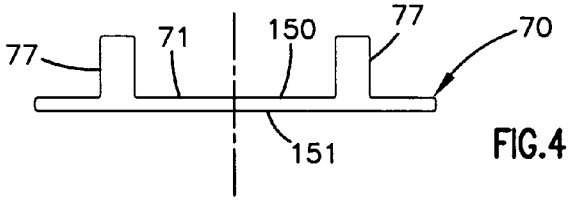
FIG. 4 is a side view of the guide of FIG. 2.
Figure 5:
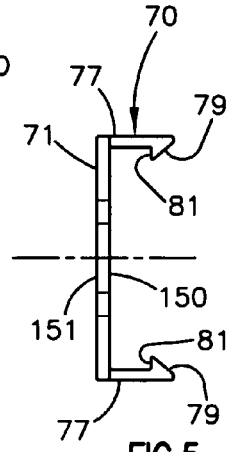
FIG. 5 is a right end view of the guide of FIG. 2.
Figure 6:
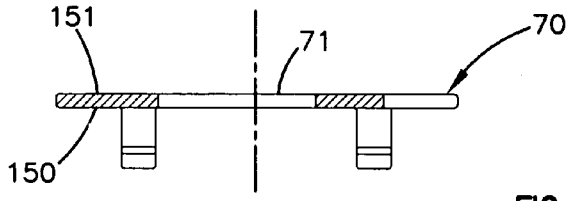
FIG. 6 is a cross-sectional view taken along section line 6—6 of FIG. 2.

The guide 70 also includes a structure for securing the guide 70 to a cartridge. For example, as shown in FIGS. 4 and 5, the guide 70 includes four resilient cantilevers 77 that project outwardly from the first side 150 of the guide plate 71. Each of the cantilevers 77 has a resilient configuration and includes a ramped surface 79 and a retaining shoulder 81.

Figure 8:
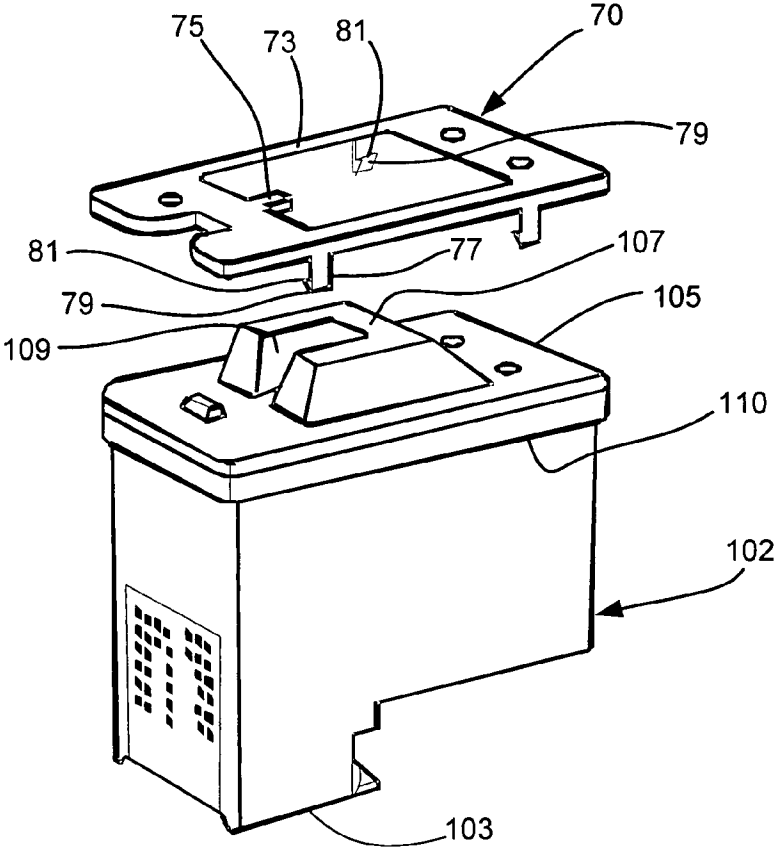
FIG. 8 illustrates the guide of FIG. 2 positioned above an ink cartridge.

Referring now to FIGS. 8–17, a method of using the kit of FIG. 1 is described. FIG. 8 shows a cartridge 102 having a print head 103 and three separate internal ink reservoirs (not shown) each adapted to contain a different color ink. The cartridge 102 also includes a cover 105 having a central, projection 107. The central projection 107 includes a notch 109. The cover 105 also includes a lip 110 that extends about the perimeter of the cartridge 102.

Referring still to FIG. 8, the guide 70 is initially positioned above the cover 105 of the cartridge 102 with the keying opening 73 in alignment with the projection 107. The guide 70 is then pressed downwardly such that the projection 107 fits within the opening 73, and tab 75 of the guide 70 fits within the notch 109 of the projection 107. As the guide 70 is pressed downwardly, the ramped surfaces 79 of the flexible cantilevers 77 engage the perimeter of the cover 105 causing the flexible cantilevers 77 to flex outwardly and to snap past the lip 110 of the cartridge 102 to a retaining position (see FIG. 9). With the flexible cantilevers snapped in the retaining position, the retaining shoulders 81 engage the underside of the lip 110 to hold the guide 70 securely on the cartridge.

Figure 9:
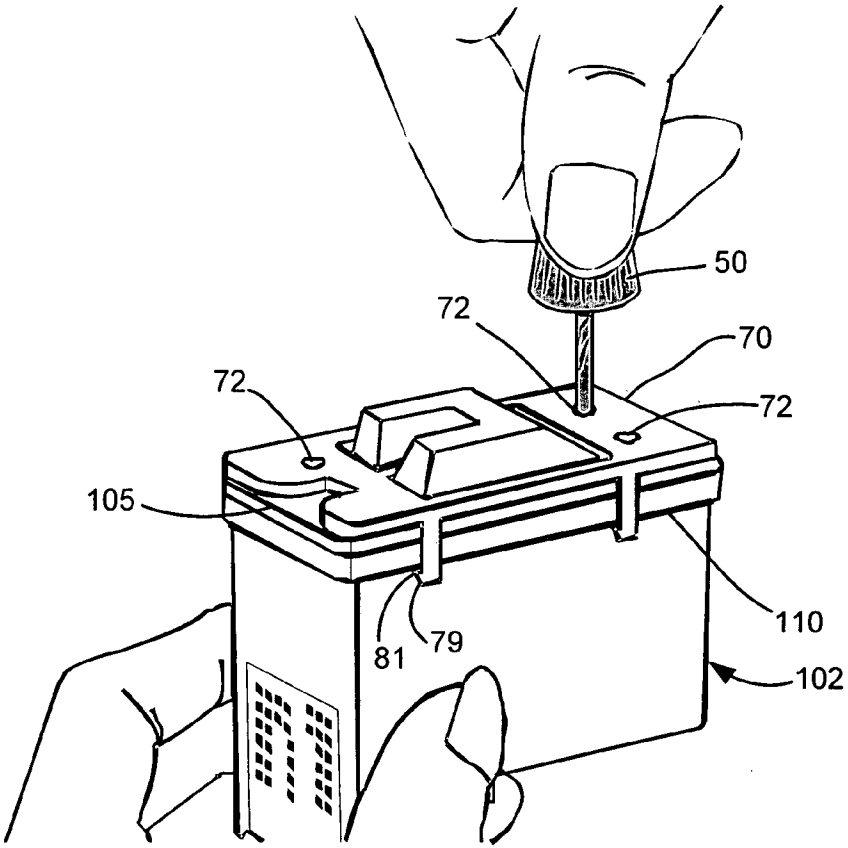
FIG. 9 shows the guide mounted on the ink cartridge and a drill being used to drill an ink refill passage in the cartridge.

Once the guide 70 has been secured to the cartridge, the drill 50 is used to drill ink refill passages through the cover 105 of the cartridge 102. As shown in FIG. 9, the guide openings 72 mark the drill locations on the cartridge 102. Thus, by using the holes 72 as drill guides, three ink refill passages can be provided at precise locations within the cover 105. Each of the locations is preferably set so as to provide access to a separate ink reservoir within the cartridge 102.

After the passages have been drilled through the cover as shown in FIG. 9, the foam drill 60 is used to extend the passages through foam within the cartridge. As the foam is drilled, the guide 70 functions as a guide for the drill 60.

Figure 11:
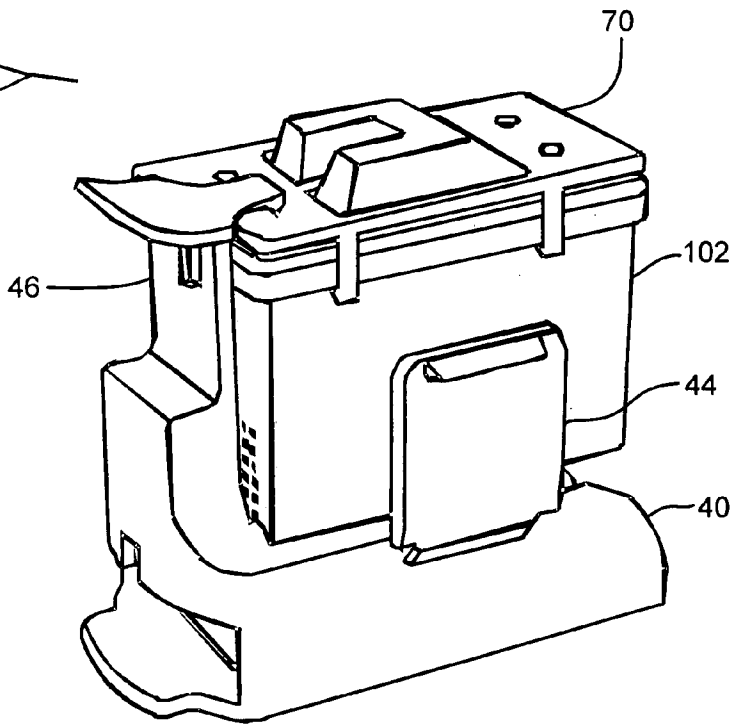
FIG. 11 illustrates the ink cartridge secured within a base.
Figure 10:
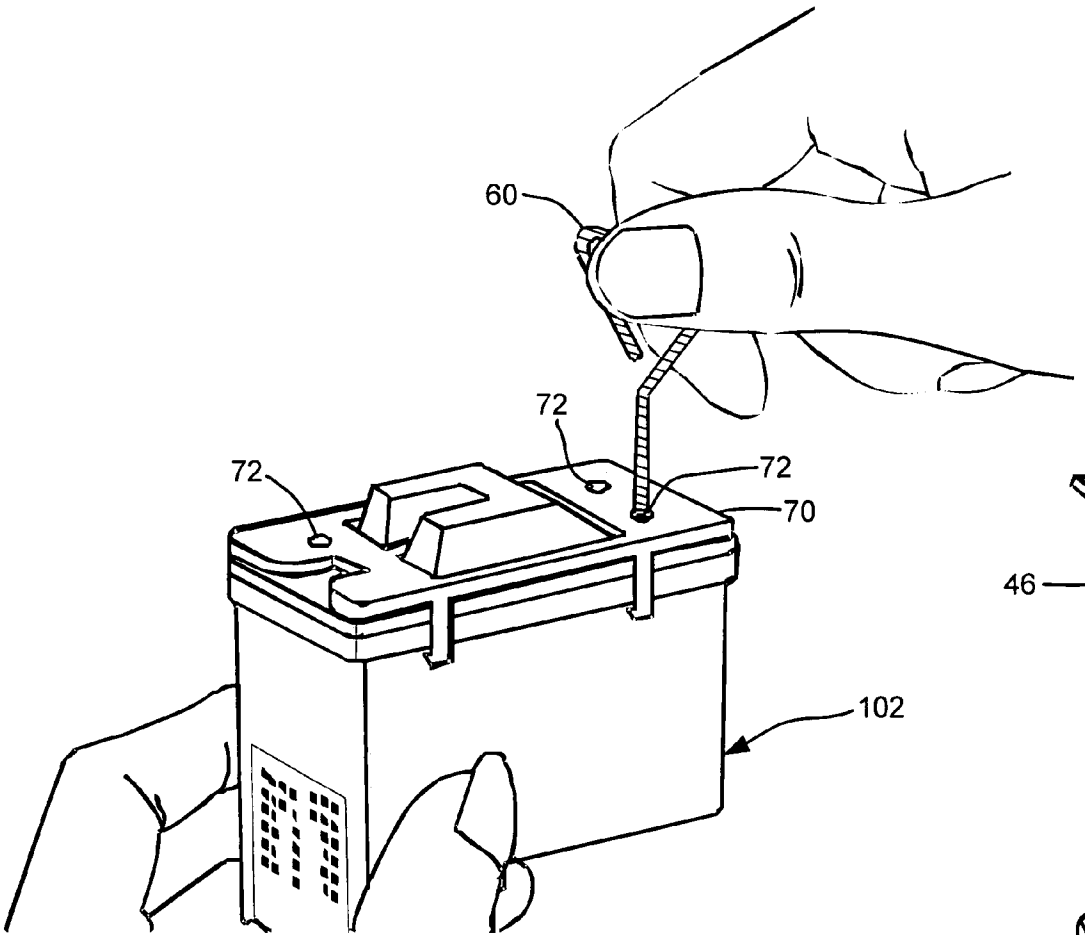
FIG. 10 illustrates a foam drill being used to extend the ink refill passage through foam on the cartridge.

After the foam has been drilled, the cartridge 102 is mounted within a cradle of the base 40 as shown in FIG. 11. The cradle is defined between tabs 44 of the base 40. The cartridge 102 is mounted in the cradle 42 by sliding the cartridge laterally between the tabs 44 until a retaining latch 46 snaps into a retaining position in which the cartridge 102 is securely held within the cradle 42.

Figure 12:
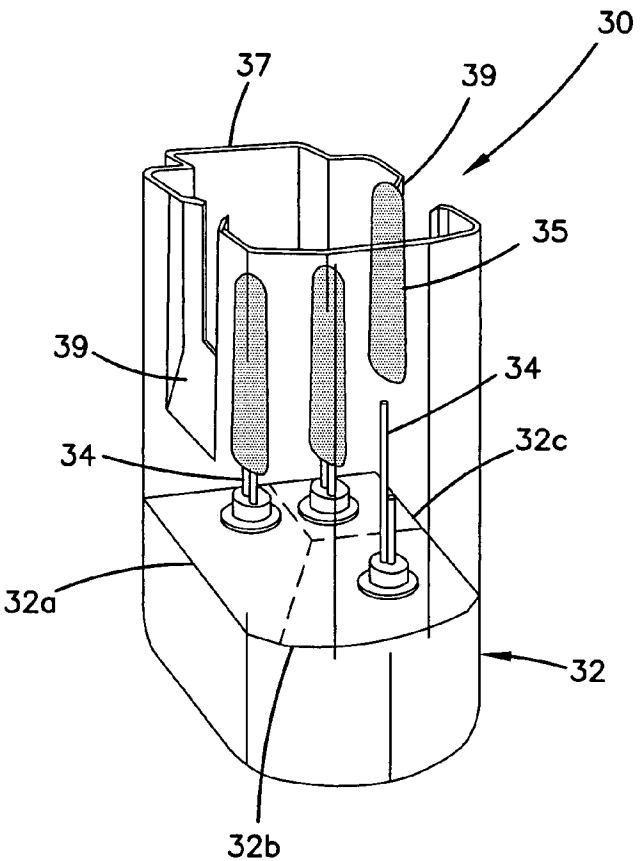
FIG. 12 illustrates an ink refill device that is part of the kit of FIG. 1.
Figure 13:
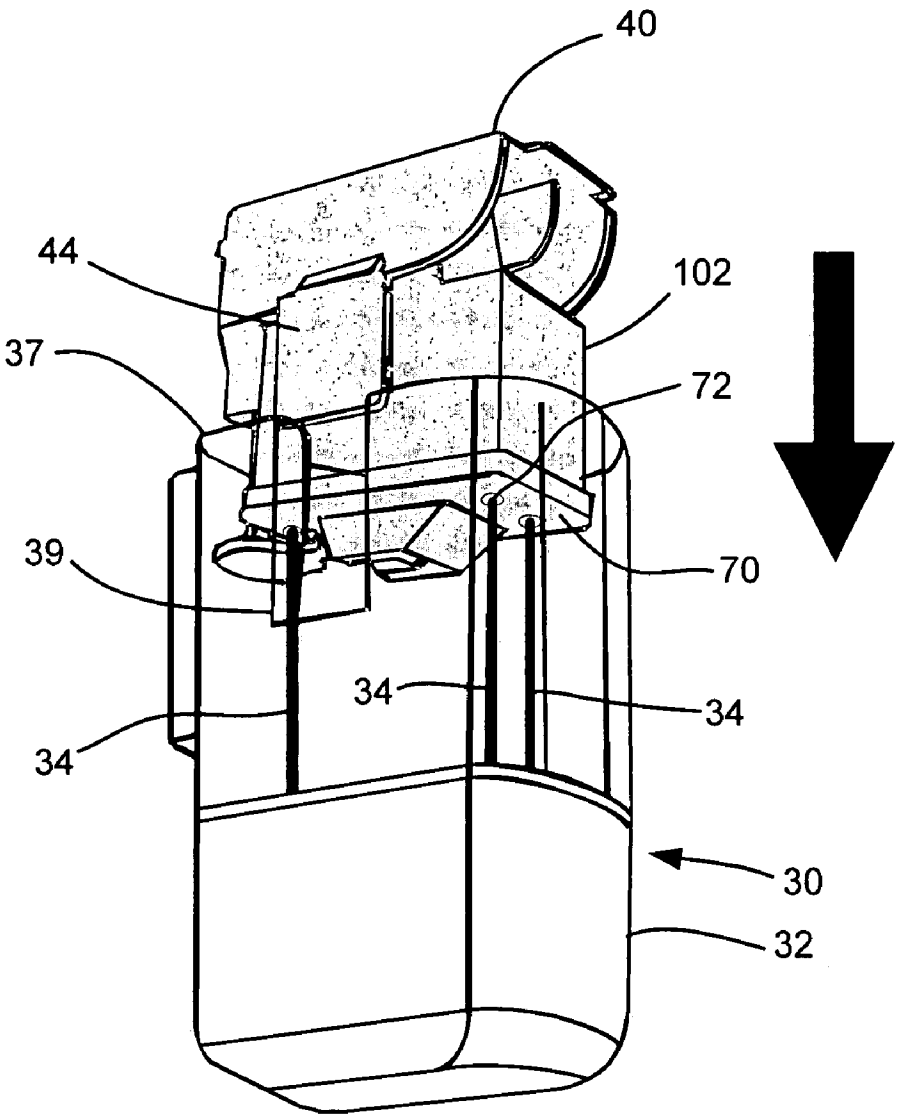
FIG. 13 illustrates the ink cartridge and base assembly of FIG. 11 being inserted into the ink refill device of FIG. 12.
Figure 14:
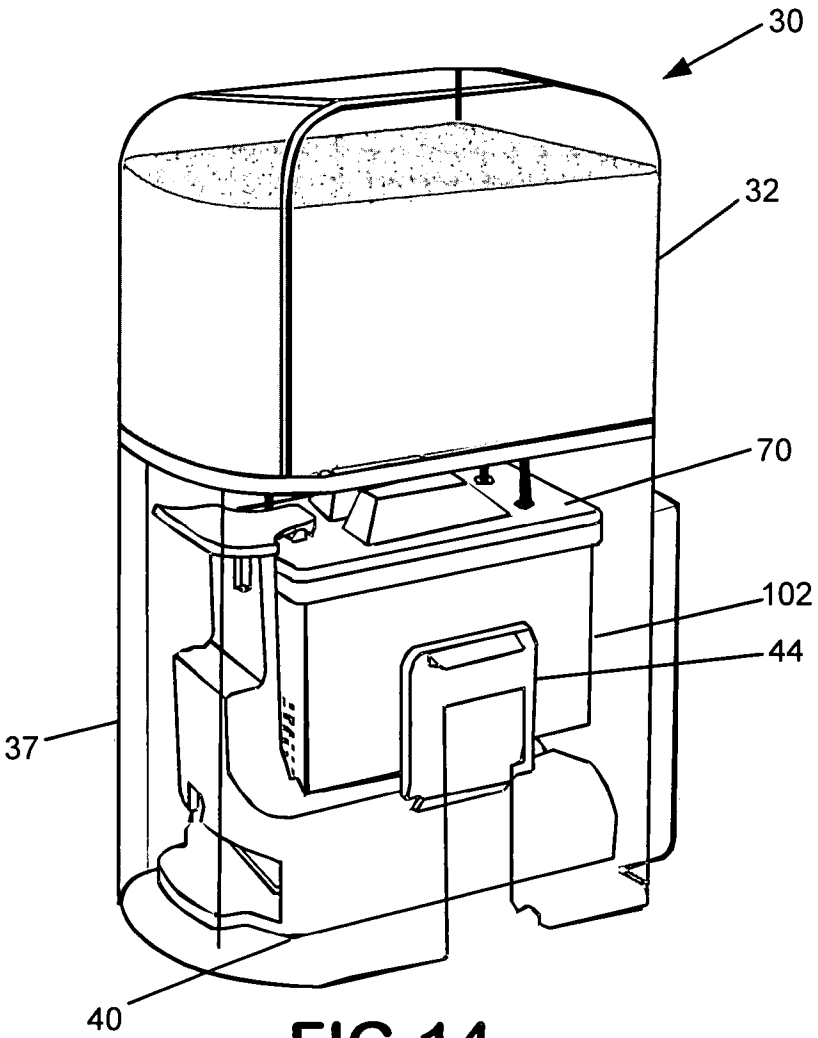
FIG. 14 illustrates the cartridge and guide assembly of FIG. 11 fully inserted into the ink refill device of FIG. 12.
Figure 17:
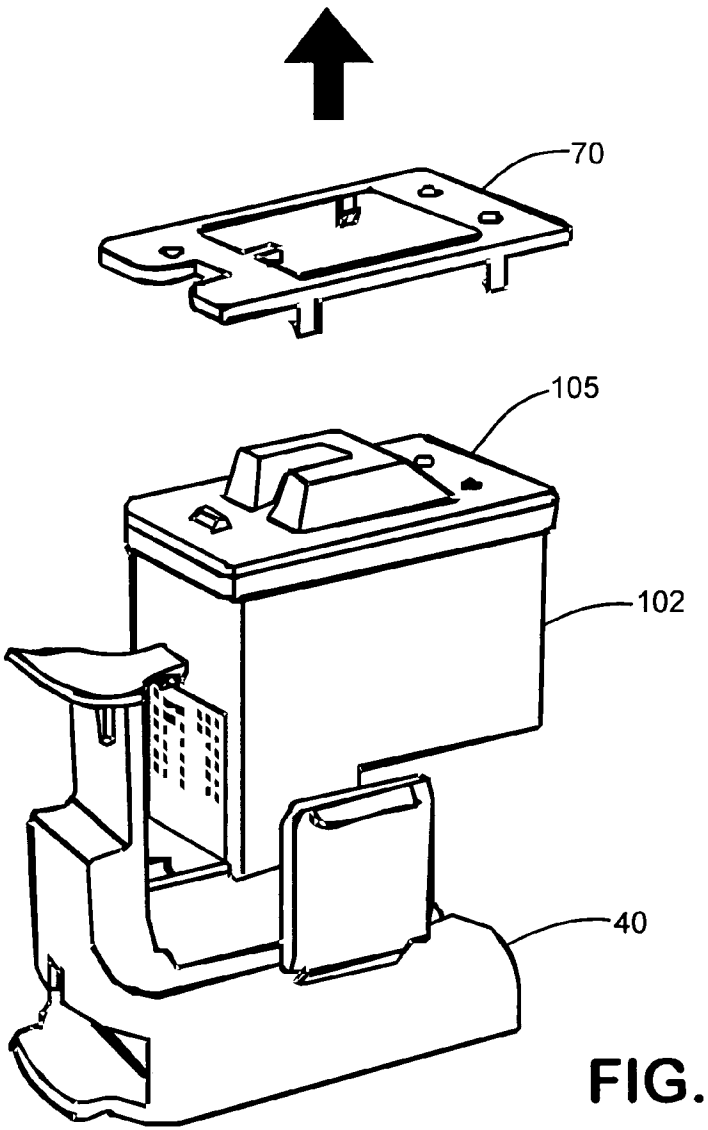
FIG. 17 illustrates the ink cartridge being removed from the base and the guide being removed from the ink cartridge.

After the cartridge 102 has been secured within the cradle, the ink-dispensing device 30 is inverted and the stoppers 35 are removed from the ink-dispensing tubes 34 (see FIG. 12). Thereafter, the base 40 is used to insert the cartridge 102 into the sleeve 37 of the ink-dispensing device 30 as shown in FIG. 13. To facilitate alignment during the insertion process, the tabs 44 of the base 40 preferably slide within the alignment tracks 39 of the sleeve 37. When the cartridge is fully inserted within the sleeve 37 as shown in FIG. 14, the tabs 44 snap outwardly into a locked position.

It is noted that during the insertion process, the guide 70 remains secured to the cover of the cartridge 102 so as to assist in guiding the ink-dispensing tubes 34 into the ink refill passages in the cartridge 102. For example, if the ink-dispensing tubes 34 are slightly misaligned, the tubes will engage the enlarged diameter portions D2 of the holes 72 and be deflected into alignment with the ink refill passages in the cartridge via the funnel structure of the openings 72.

With the cartridge 102 fully inserted within the sleeve 37 of the ink-dispensing device 30, the ink-dispensing device 30 is turned upright (see FIG. 14) causing ink to flow downwardly through the ink-dispensing tubes 34 into the chambers of the cartridge 102. If ink does not begin to flow when the ink-dispensing device 30 is turned upright, the ink tank 32 can be squeezed to create pressure that helps start the flow of ink.

Figure 16:
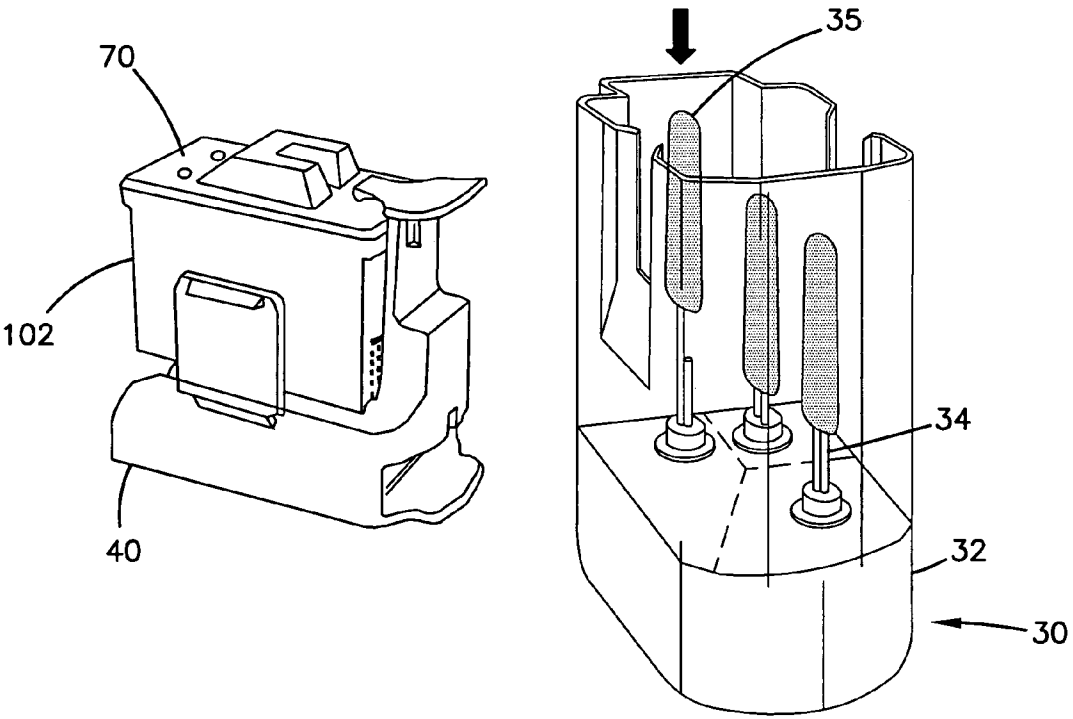
FIG. 16 illustrates the ink cartridge and base assembly of FIG. 11 fully separated from the ink refill device of FIG. 12 with stoppers being inserted over tubes of the ink refill device.
Figure 15:
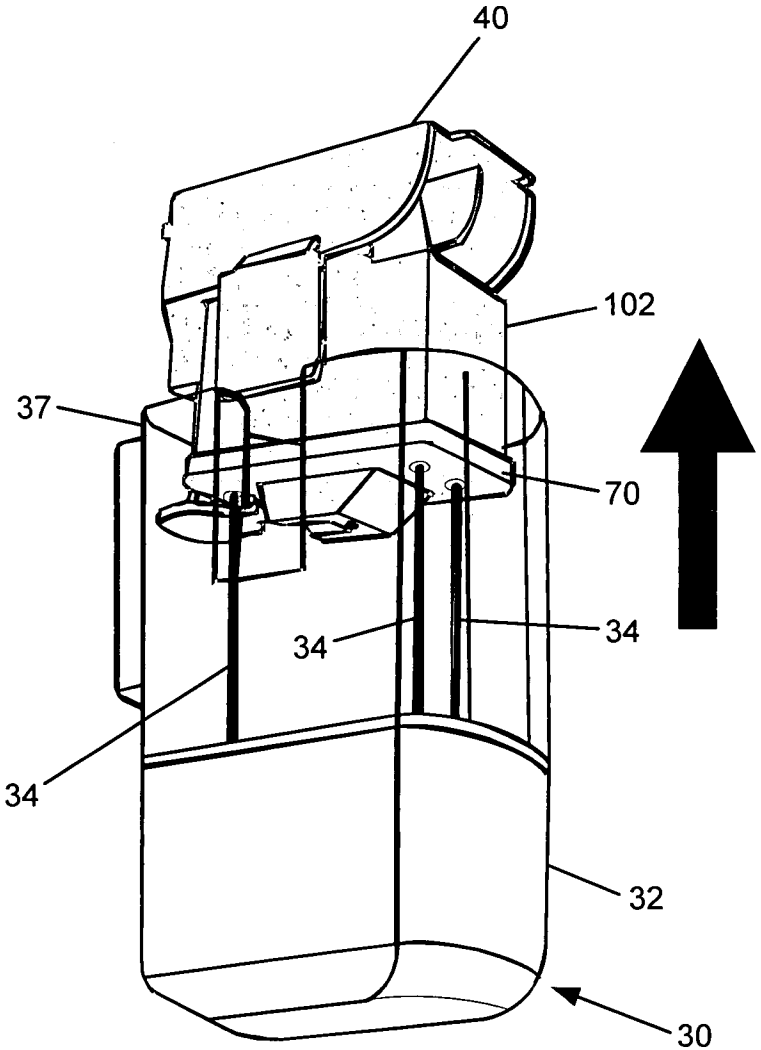
FIG. 15 illustrates the ink cartridge and base assembly of FIG. 11 being removed from the ink refill device of FIG. 12.

After the reservoirs of the cartridge 102 have been filled, the ink-dispensing device 30 is again inverted, and the tabs 44 of the base are squeezed together to disengage the tabs from the sleeve 37. The base 40 and cartridge 102 can then be slowly pulled from the sleeve 37 as shown in FIG. 15. Thereafter, the stoppers 35 are again placed on the ink-dispensing tubes 34 as shown in FIG. 16. The refilling process is completed by removing the cartridge 102 from the base 40, and by removing the guide 70 from the cover 105 of the cartridge (see FIG. 17). After refilling, the cartridge is again ready for use in a printer.

As indicated above, for other cartridges such as Lexmark No. 83 (18L0042) or Dell 7Y745 cartridges, it is not necessary to drill through the housing of the cartridge. Instead, the lid remover 80 can be used to remove a lid from the cartridge. Thereafter, the guide 70 can be mounted on the cartridge and used to guide the foam drill 60 as well as the ink-dispensing tubes 34 as described above.

It will be appreciated that the drill guide 70 described above is configured to accommodate particular models of cartridges. It will be appreciated that the hole locations and keying configurations can be varied to accommodate different models of cartridges. Similarly, the retaining arrangement of the guide 70 can also be varied to accommodate different models of cartridges. Moreover, it will be appreciated that for cartridges having more than three reservoirs, more than three openings can be provided in the guide. Similarly, the guide can have fewer than three openings to correspond to cartridges having fewer than three ink reservoirs.

With regard to the foregoing description, it is to be understood that changes may be made in detail, especially with respect to the shape, size and arrangement of the parts. It is intended that the specification and depicted aspects be considered illustrative only and not limiting with respect to the broad underlying concepts of the present disclosure.

What is claimed is:

1. An ink cartridge refill system for refilling an ink cartridge, the system comprising:

a guide structure that mounts to the ink cartridge, the guide structure defining a guide opening that aligns with an ink refill passage of the cartridge, the guide structure including a first side that faces toward the cartridge and a second side that faces away from the cartridge, wherein the guide opening has a first diameter at the first side and a second diameter at the second side, the second diameter being larger than the first diameter;

an ink refill device including:

at least one ink tank;

at least one ink-dispensing tube for delivering ink from the tank to the cartridge; and a cartridge guide connected to the ink tank for receiving the ink cartridge with the guide structure mounted thereon, wherein when the cartridge is received within the cartridge guide, the guide opening of the guide structure aligns generally with the ink-dispensing tube so as to guide the ink-dispensing tube into the ink refill passage.

2. The system of claim 1, wherein the guide structure is secured to the ink cartridge by a snap-fit connection.

3. The system of claim 1, wherein the guide structure is secured to the ink cartridge by retainers including resilient cantilever members.

4. The system of claim 1, wherein the ink refill device includes three ink chambers each containing a different color ink, wherein the ink refill device includes ink-dispensing tubes corresponding to each of the ink chambers, and wherein the guide structure defines three guide openings positioned to align with the ink-dispensing tubes when the cartridge is received in the cartridge guide.

5. The system of claim 1, further comprising a drill for forming the ink refill passage in the cartridge.

6. The system of claim 5, wherein the guide opening of the guide structure functions as a drill guide.

7. The system of claim 1, wherein the guide structure includes a plate having an opening that is keyed to ensure the guide structure is mounted on the cartridge at a desired rotational orientation.

8. The system of claim 1, wherein the guide opening is tapered.

9. The system of claim 1, wherein the guide opening is funnel-shaped.

10. The system of claim 1, wherein the second diameter is at least 30 percent larger than the first diameter.

11. An ink cartridge refill system for refilling an ink cartridge, the system comprising:

a guide structure that mounts to the ink cartridge, the guide structure defining three guide openings that align with desired refill passage locations of the cartridge, the guide structure including a first side that faces toward the cartridge and a second side that faces away from the cartridge, wherein the guide openings each include a tapered entrance at the second side;

a drill adapted to be inserted through the guide openings to drill refill passages through the cartridge an ink refill device including:

three ink chambers;

an ink-dispensing tube corresponding to each of the chambers; and a cartridge guide connected to the ink tank for receiving the ink cartridge with the guide structure mounted thereon, wherein when the cartridge is received within the cartridge guide, the guide openings of the guide structure align generally with the ink-dispensing tubes so as to guide the ink-dispensing tubes into the refill passages.

12. The system of claim 11, wherein the guide structure includes a plate having an opening that is keyed to ensure the guide structure is mounted on the cartridge at a desired rotational orientation.

13. The system of claim 11, wherein the guide openings are funnel-shaped.

14. The system of claim 11, wherein the guide openings each have a first diameter at the first side and a second diameter at the second side, the second diameters being larger than the first diameters.

15. The system of claim 14, wherein the second diameters are at least 30 percent larger than the first diameters.

16. An ink cartridge refill system for refilling an ink cartridge, the system comprising:

a guide structure that mounts to the ink cartridge, the guide structure defining a guide opening that aligns with an ink refill passage of the cartridge, the guide structure including a plate having an opening that is keyed to ensure the guide structure is mounted on the cartridge at a desired rotational orientation;

an ink refill device including:

at least one ink tank;

at least one ink-dispensing tube fbr delivering ink from the tank to the cartridge; and a cartridge guide connected to the ink tank for receiving the ink cartridge with the guide structure mounted thereon, wherein when the cartridge is received within the cartridge guide, the guide opening of the guide structure aligns generally wit the ink-dispensing tube so as to guide the ink-dispensing tube into the ink refill passage.

* * * * *